United States Patent [19]

Ishida

[11] 4,416,178

[45] Nov. 22, 1983

[54] TOUCH RESPONSE PROVIDING APPARATUS

[75] Inventor: Hideaki Ishida, Hachioji, Japan

[73] Assignee: Casio Computer Co., Ltd., Tokyo, Japan

[21] Appl. No.: 330,843

[22] Filed: Dec. 15, 1981

[30] Foreign Application Priority Data

Dec. 22, 1980 [JP] Japan ..... 55-182230
Dec. 22, 1980 [JP] Japan ..... 55-182231

[51] Int. Cl.[3] ..... G10H 1/06; G10H 1/34; G10H 1/46

[52] U.S. Cl. ..... 84/1.19; 84/1.1; 84/1.27; 84/DIG. 7; 200/5 A; 200/5 B; 340/365 S; 340/365 A

[58] Field of Search ..... 84/1.09-1.13, 84/1.19-1.27, DIG. 7; 200/5 A, 5 B, 5 C, DIG. 32; 340/365 R, 365 S, 365 A

[56] References Cited

U.S. PATENT DOCUMENTS 3,935,784 2/1976 Koepke ..... 84/DIG. 7
4,044,642 8/1977 Pearlman et al. ..... 84/1.1
4,067,253 1/1978 Wheelwright et al. ..... 84/1.1
4,079,651 3/1978 Matsui ..... 84/1.1
4,217,803 8/1980 Dodds ..... 84/1.1
4,362,934 12/1982 McLey ..... 84/1.1 X

FOREIGN PATENT DOCUMENTS 2,164,338 11/1974 Fed. Rep. of Germany .

OTHER PUBLICATIONS

Funkschau 1977, Heft 24, "Piezotasten sorgen fur Pianoeffekt in elektronischen orgein, pp. 81-82.

*Primary Examiner*—S. J. Witkowski
*Attorney, Agent, or Firm*—Frishauf, Holtz, Goodman & Woodward

[57] ABSTRACT

First to third switch contact pairs are provided for each of the performance keys of an electronic keyboard musical instrument such that they are successively closed in an interlocked relation to the operation of the associated key. A first time interval from the closure of the first switch contact pair till the closure of the second switch contact pair and a second time interval from the closure of the second switch contact pair till the closure of the third switch contact pair are counted in a CPU, and their ratio is obtained therein. The tone color of the output musical signal is controlled according to the value of this ratio, and the volume of the musical signal is controlled according to the length of the second time interval.

16 Claims, 13 Drawing Figures

TOUCH RESPONSE PROVIDING APPARATUS

BACKGROUND OF THE INVENTION

This invention relates to a touch responsive apparatus which controls the characteristics of a musical sound such as volume and tone color according to the state of depression of an operated performance key of an electronic musical instrument, for instance the speed of depression of the key or the depressing force.

Touch responsive devices which control the volume and tone color of a musical signal according to the key depression speed have been developed. With such devices, however, it is only possible to obtain a keen sound of high volume when the key depression speed is high and to obtain a soft sound of a low volume when the key depression speed is low. A soft sound of a large volume, for instance, cannot be obtained. Therefore, it is impossible to obtain musically rich expression as is obtainable with a natural musical instrument. Further, with the aforementioned known apparatus, touch response is provided for each key in an analog fashion. Therefore, the hardware of the electronic musical instrument is extremely complicated, leading to increased cost and unstable operation.

SUMMARY OF THE INVENTION

An object of the invention is to provide a touch responsive apparatus, which permits the player to obtain a performance containing musically rich expression without requiring any increase of the hardware of the electronic musical instrument.

According to the invention, this objective is attained by a touch responsive apparatus comprising at least three switches provided for each of the performance keys of the electronic musical instrument and switched in a predetermined order at the time of the operation of each key, means for counting the periods required for the switching of the individual switches at the time of the key operation, and means for controlling at least two characteristics of the musical sound produced in corredpondence to the key operation according to the count output of the counting means.

DETAILED DESCRIPTION OF THE PREFERRED EMBODIMENTS

Figure 1:
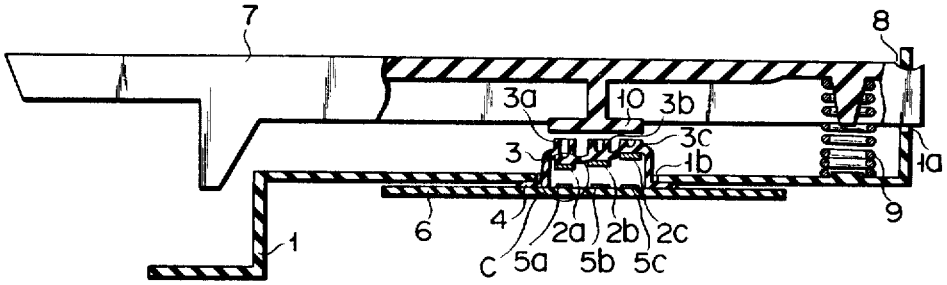
FIG. 1 is a sectional view showing the construction of a keyboard portion in one embodiment of the touch response providing apparatus according to the invention.

FIG. 1 shows an embodiment of the invention. A keyboard chassis 1 has a vertical back portion, which is formed with an engagement window 1*a* for each key, and has a horizontal portion, which is formed with a see-through hole or opening 1*b* for each key. An elastic member 4, for instance made of rubber, is secured to the underside of the keyboard chassis 1 such that its protruding portion 3 upwardly penetrates the opening 1*b*. Movable contacts 2*a*, 2*b* and 2*c* are provided on the underside surface of the top of the protruding portion 3. A printed circuit board 6, on which a set of fixed contacts 5*a*, 5*b* and 5*c* corresponding to the respective movable contacts 2*a*, 2*b* and 2*c* and predetermined wiring are formed, is secured in a laminated fashion to the underside of the elastic member 4. The movable contacts 2*a*, 2*b* and 2*c* depend from the top of the protruding portion 3 to different extents, and face the respective fixed contacts 5*a*, 5*b* and 5*c*. The extent is greater with the contact on the front side of the keyboard chassis 1 (i.e., left side in FIG. 1) than that with the next one. Portions of the portion 3 connecting the movable contacts 2*a* and 2*b* and connecting the movable contacts 2*b* and 2*c* have a reduced thickness and are capable of being deformed by downward urging pressure.

A performance key 7 has a stem portion 8 formed with an upper recess. This stem portion 8 is engaged in the aforementioned engagement window 1*a*, and the key 7 is normally held upwardly biased by a compression coil spring 9.

The key 7 has an urging portion 10 facing the protruding portion 3 protruding through the opening 1*b* mentioned above. When the key 7 is depressed, the protruding portion 3 is urged by the urging portion 10, whereby the movable contacts 2*a*, 2*b* and 2*c* are successively made with the respective fixed contacts 5*a*, 5*b* and 5*c*.

When releasing the key, at which time the urging portion 10 is upwardly displaced, the movable contacts 2*c*, 2*b* and 2*a* are successively broken apart from the associated fixed contacts 5*c*, 5*b* and 5*a* in the mentioned order.

When the key 7 is released, it is brought to the position shown in FIG. 1 by the force of the coil spring 9. In this state of the key, the upper ends of switch actuators 3*a*, 3*b* and 3*c* projecting from the top of the protruding portion 3 and corresponding to the respective movable contacts 2*a*, 2*b* and 2*c* are at an equal distance from the underside of the urging portion 10. Meanwhile, as for the distances of the movable contacts 2*a* to 2*c* with respect to the respective fixed contacts 5*a* to 5*c*, the distance between the contacts 2*a* and 5*a* is shortest, and the distance between the contacts 2*c* and 5*c* is greatest.

Figure 1A:
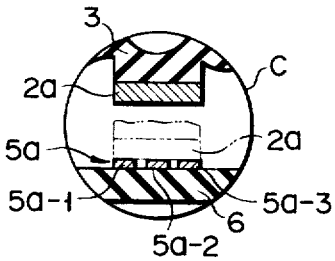
FIG. 1A is an enlarged-scale view showing a portion enclosed in a circle C in FIG. 1.

FIG. 1A shows the detailed construction of a portion enclosed in a circle C including the contacts 2*a* and 5*a*. The fixed contact 5*a* actually consists of three printed wiring leads 5*a*-1, 5*a*-2 and 5*a*-3 formed on the printed circuit board 6. The lead 5*a*-2 is connected to a common electrode, while the opposite end leads 5*a*-1 and 5*a*-3 are commonly connected to an independent electrode, as will be described hereinafter in detail. Thus, when the key 7 is depressed, the movable contact 2*a* is displaced from the position of solid lines down to the position of bouble dot and bar lines, and its underside is brought into contact with the upper surfaces of the fixed contact leads 5*a*-1 to 5*a*-3. As a result, the common electrode KC and independent electrode KI are connected to each other. The other fixed contacts 5*b* and 5*c* have the same construction. That is, the contact pairs 2*a* and 5*a*, 2*b* and 5*b* and 2*c* and 5*c* act as switches opened and closed with the operation of the key 7.

Figure 2:
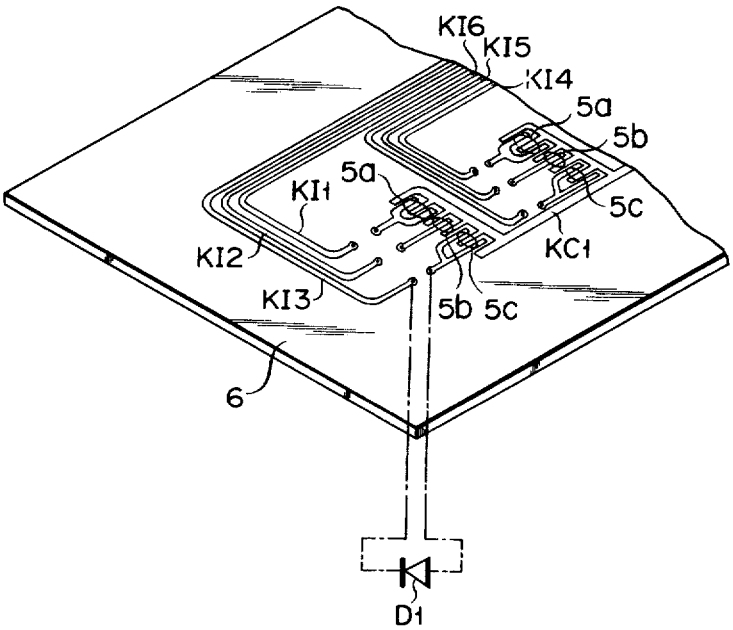
FIG. 2 is a perspective view showing a printed circuit board shown in FIG. 1.

FIG. 2 shows the printed circuit board 6 in detail. On the surface of the printed circuit board 6, common electrodes and independent electrodes used as fixed contacts 5*a* to 5*c* for each of the keys are provided by printed wiring. Here, portions used as the fixed contacts 5*a* to 5*c* are shown by dashed lines. The fixed contacts 5*a* to 5*c* consist of a common electrode KC1 (electrodes KC2 to KC4 being described later) and independent electrodes KI1 to KI3 or KI4 to KI6 (other electrodes being described later). As mentioned before, these fixed contacts 5*a* to 5*c* are on-off controlled by the respective movable contacts 2*a* to 2*c*. On the lower side of the printed circuit board 6, a diode D1 (and other diodes D2 to D144) for permitting forward current signal of the electrodes KI1 to KI3 (and other electrodes) are provided.

Figure 3:
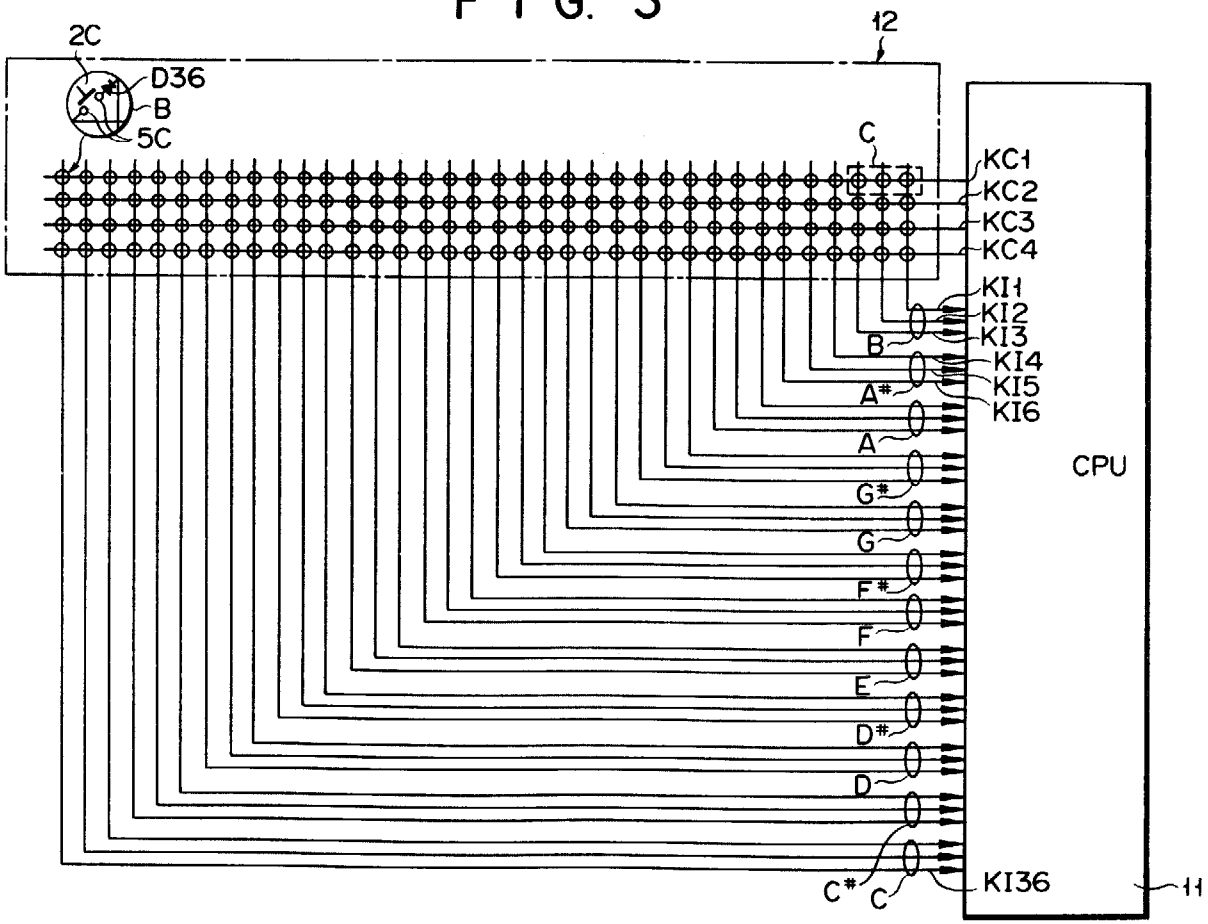
FIG. 3 is a circuit diagram showing a key input section including a key matrix circuit embodying the invention.

FIG. 3 shows the circuit construction of the keyboard mentioned above. In this embodiment, the keyboard covers four octaves, i.e., has 48 keys.

A CPU 11, which may be a microprocessor, provide sequential pulses of different phases to the common electrodes KC1 to KC4 mentioned above. The electrode KC1 corresponds to the highest octave, the electrodes KC2 and KC3 correspond to intermediate octaves, and the electrode KC4 corresponds to the lowest octave. A key matrix circuit 12 has intersections, each of which has a construction as shown in a circle B. As is shown, a switch circuit including a movable contact (the contact 2*c* being shown), a fixed contact (the contact 5*c* being shown) and a diode (the diode D36 being shown) is provided at the intersection. Of these switches, three successively provided on the same common electrode KCi (i being 0 to 4) corresponds to the same key. For example, shown at C is a switch circuit consisting of three switches for the note B4 in the highest octave.

From the key matrix circuit 12, 36 electrode lines KI1 to KI36 are leading, and these lines are connected to the CPU 11. The electrodes KI1 to KI3 correspond to the note B in each octave, the electrodes KI4 to KI6 corresponds to the note A#, and so on. That is, the electrode sets each of three electrodes corresponds to respective 12 different notes.

Figure 4A:
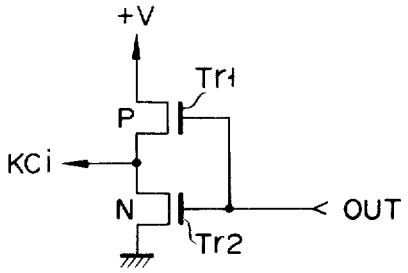
FIGS. 4A and 4B are circuit diagrams showing input and output driver circuits in a CPU shown in FIG. 3.
Figure 4B:
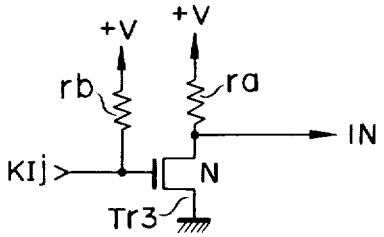

FIGS. 4A and 4B show the constructions of input and output drivers inside the CPU 11. FIG. 4A shows the output driver, which is connected to the common electrode KCi (i being 1 to 4) and supplies a sequential pulse signal. This driver has a CMOS construction including a series circuit of a p-channel MOS FET Tr1 and an n-channel MOS FET Tr2. When a ground level signal is impressed upon a terminal OUT, the p-channel MOS FET Tr1 is triggered to provide a +V level signal. Conversely, when a +V level signal is impressed upon the terminal OUT, an n-channel MOS FET Tr2 is triggered to provide a ground level signal.

FIG. 4B shows the input driver. This driver has an inverter construction including an n-channel MOS FET Tr3 and MOS resistors $r_a$ and $r_b$. If the output signal from the electrode KIj (j being 1 to 36) is at a +V level, a ground level signal is provided from a terminal IN. Conversely, if the output signal from the electrode KIj is at a ground level, a +V level signal is provided from the terminal IN.

Figure 5:
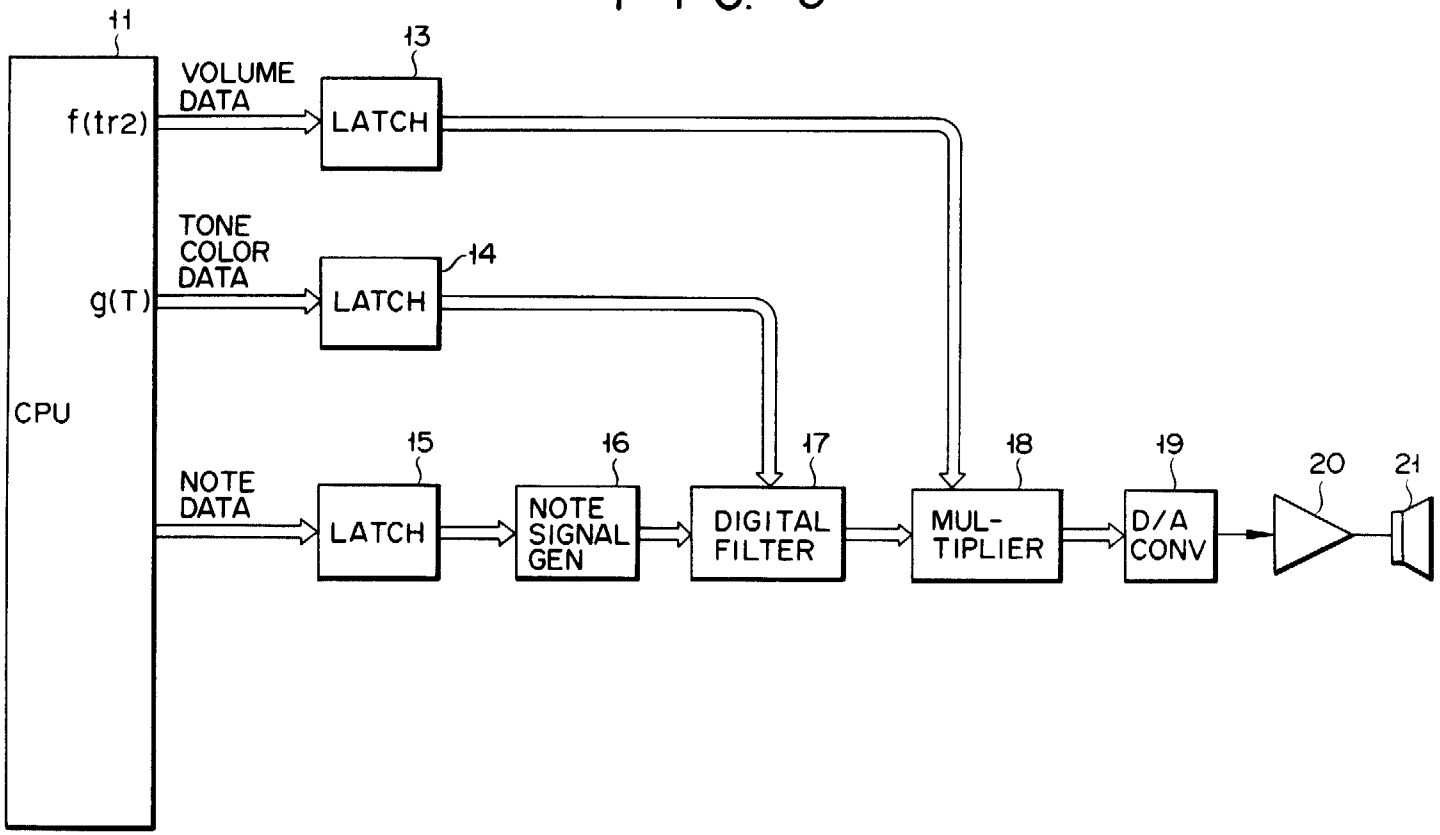
FIG. 5 is a block diagram showing a tone generating section in the embodiment of the invention.

As shown in FIG. 5, the CPU 11 supplies volume data f (tr2) (to be described later) to a latch 13, a filter (tone color) data g (T) (to be described later) to a latch 14 and note data to a latch 15.

A tone signal generator 16 operates according to the tone data stored in the latch 15 and supplies a digital signal representing a predetermined waveform at a corresponding frequency to a digital filter 17.

To the digital filter 17 is supplied, in addition to the output of the note signal generator 16, the filter data g (T) stored in the latch 14, whereby filtering is effected digitally. This digital filter 17 is disclosed, for instance, in U.S. Ser. No. 256,187 entitled "Digital Filter System" filed Apr. 21, 1981 by the applicant.

The output of the digital filter 17 is coupled to a multiplier 18, which produces the product of this input and the volume data latched in the latch 13 and supplies the result to a digital/analog (D/A) converter 19. The D/A converter 19 produces an analog signal, which is coupled through a power amplifier 20 to a loudspeaker 21 for producing the relevant musical sound.

Figure 6:
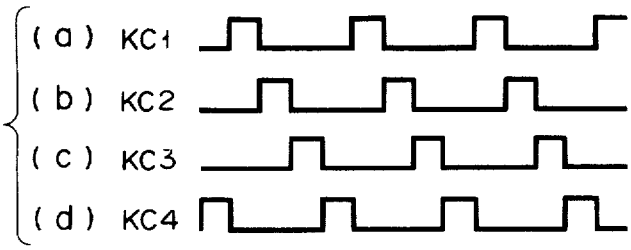
FIG. 6 is a time chart illustrating the scanning of the key matrix circuit shown in FIG. 3.

The operation of this embodiment will now be described. Sequential pulses as shown in (a) to (d) in FIG. 6 are supplied to the common electrodes KC1 to KC4 as shown in FIG. 3 for scanning the switch circuits in the key matrix circuit 12. At this time, signals obtained as a result of inversion of the levels of the signals shown in (a) to (d) in FIG. 6 are impressed upon the terminal OUT shown in FIG. 4A.

Thus, the detection of the "on" and "off" states of each key on the keyboard is effected in synchronism to the sequential pulses shown in (a) to (d) in FIG. 6. When the key of, for instance, note B4 in the highest octave (corresponding to the common electrode KC1), i.e., the key 7 shown in FIG. 1, is depressed, the movable contacts 2*a*, 2*b* and 2*c* in the switch circuit C shown enclosed in a dashed rectangle in FIG. 3 are successively made with the respective fixed contacts 5*a*, 5*b* and 5*c* in the mentioned order.

Figure 7:
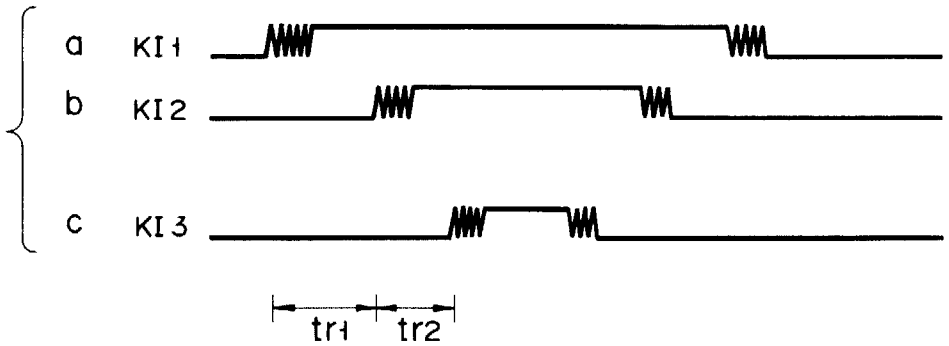
FIG. 7 is a waveform diagram showing key operation signals obtained from three switches with a key operation.

The manner, in which these switches are operated, is shown in (a) to (c) in FIG. 7. Key depression signals with chattering from the contact pairs 2*a* and 5*a*, 2*b* and 5*b* and 2*c* and 5*c* are provided on the respective electrodes KI1 to KI3. As a result, inversed signals of these signals are coupled through the driver shown in FIG. 4B to the CPU 11.

Figure 8:
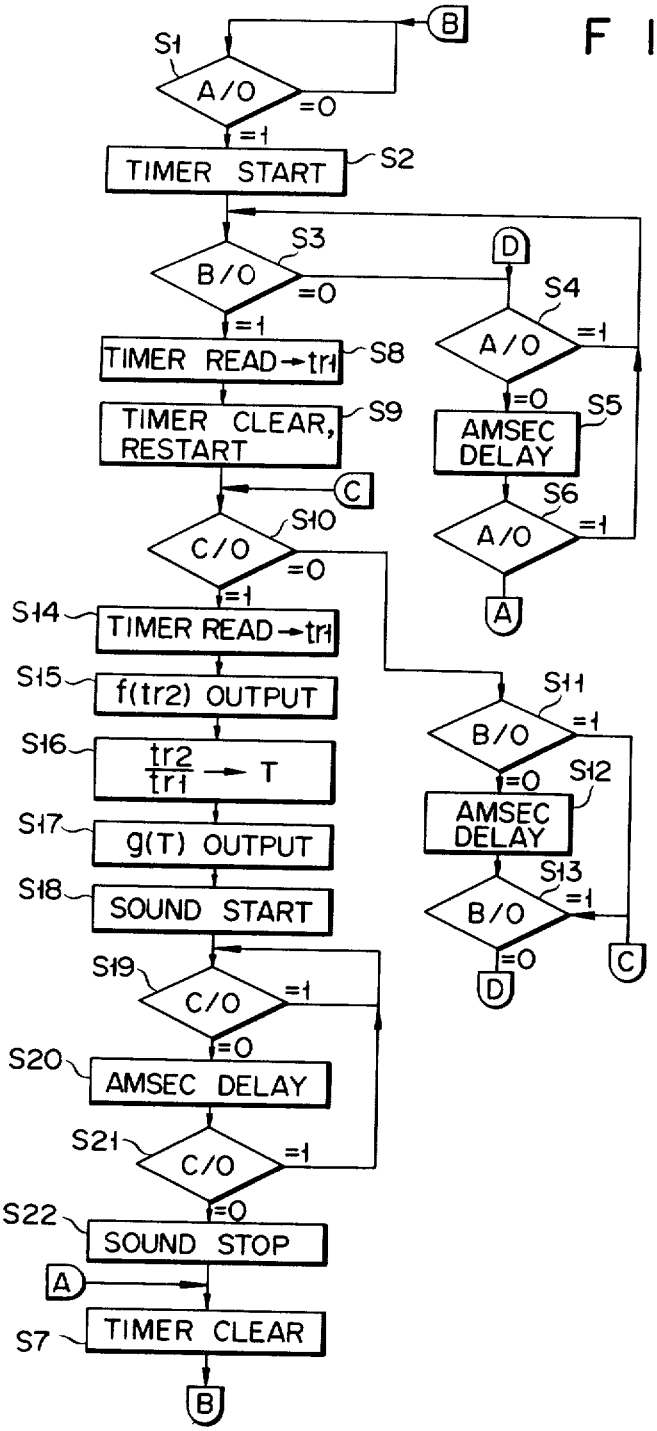
FIG. 8 is a flow chart illustrating the operation of the embodiment of the invention.

The operation of the CPU 11 will now be described with reference to FIG. 8. In this flow chart, labeled "A" is the state of the movable contact 2*a* and fixed contact 5*a* relative to each other; more particularly when the contact pair is in the "on" state A=1 and when the contact pair is in the "off" state A=0. Likewise, the state of the contact pair of the contacts 2*b* and 5*b* and that of the contact pair of the contacts 2*c* and 5*c* are respectively represented by "B" and "C".

Now, the case when the key 7 corresponding to the highest octave note B4 is operated will be taken. In a step S1, whether the switch consisting of the movable contact 2*a* and fixed contact 5*a* is "on" is checked. If the "on" state is detected, the operation proceeds to a step S2, in which a timer is started. The timer, which is provided in the CPU 11, may include a register and an adder and effects counting.

Then, a step is executed, in which the state of the switch consisting of the movable contact 2b and fixed contact 5b is checked. If it is detected that the contacts 2b and 5b are not in contact with each other, a step S4 is executed, in which the state of the switch consisting of the movable contact 2a and fixed contact 5a is checked. If the "off" state of the switch, with chattering produced between the movable contact 2a and fixed contact 5a, is detected, a step S5 is executed. If the "on" state of the switch consisting of the contacts 2a and 5a is detected in the step S4, the operation returns to the step S3.

In the step S5, the detection of the switch state is interrupted for the chattering period, for instance 4 msec, and a step S6 is executed after the 4 msec. In the step S6 whether the switch of the contacts 2a and 5a are "on" is checked. If the switch is "off", a decision that the key has not been operated is made, and the operation proceeds to a step S7. In the step S7, the timer is cleared, and the operation returns to the step S1.

In the instant case, i.e., with the movable contact 2a and fixed contact 5a in contact with each other with the key 7 depressed, the operation returns to the step S3 after the execution of the step S6. The CPU 11 thus repeatedly executes the steps S3 and S4 until the movable contact 2b and fixed contact 5b are made.

When it is detected in the step S3 that the switch of the contacts 2b and 5b is in the "on" state, the operation proceeds to a step S8, in which the count content of the aforementioned timer is stored in a predetermined register (referred to here as X register). The data stored in the X register is referred to as tr1 (see FIG. 7). Then, a step S9 is executed, in which the timer is cleared and the counting operation is restarted.

Then, a step S10 is executed, in which whether the switch consisting of the movable contact 2c and fixed contact 5c is detected. Since at the instant moment the switch of the contacts 2c and 5c is not "on" yet, the operation proceeds to a step S11.

In the step S11, whether the switch of the contacts 2b and 5b is "on" is checked. If the "off" state of the switch, with chattering produced between the movable contact 2b and fixed contact 5b, is detected, the operation proceeds to a step S12, in which the detection of the switch state is interrupted for 4 msec. After 4 msec a step S13 is executed, in which whether the switch of the contacts 2b and 5b is "on" is checked. If it is found in the step S13 that the key 7 has been depressed only up to an extent to make the movable contact 2b and fixed contact 5b, the operation returns to the step S4 for detecting the state of the switch consisting of the movable contact 2a and 5a. In the instant case, the "on" state is brought about after the production of chattering between the movable contact 2b and fixed contact 5b, and the step S10 is executed.

After the switch on the contacts 2b and 5b are turned "on", the CPU 11 repeatedly executes the steps S10 and S11.

If it is detected in the step S10 that the switch consisting of the movable contact 2c and fixed contact 5c is in the "on" state, a step S14 is executed. In the step S14, the count content of the aforementioned timer is stored in a predetermined register (referred to here as Y register). The data stored in the Y register is referred to as tr2 (see FIG. 7). Then, a step S15 is executed, in which the volume data f (tr2) is calculated according to the data tr2 stored in the Y register and is transmitted to the latch 13.

Then, a step S16 is executed, in which the ratio tr2/tr1 is obtained from the data tr1 stored in the X register and the data tr2 stored in the Y register. On the basis on the ratio data T, the filter data g (T) is obtained in a step S17, and it is transmitted to the latch 14 shown in FIG. 5. The filter data g (T) is a data for setting the cut-off frequency of a low-pass filter, for instance.

Then, a step S18 is executed, in which in the instant case the data of the highest octave note B4 is transmitted to the latch 15 to operate the tone signal generator 16. As a result, a volume corresponding to the data tr2 is set in the multiplier 18 according to the output of the tone signal generator 16, and the digital filter 17 provides a filtering action at the cut-off frequency corresponding to the aforementioned data T (tr2/tr1) is provided.

As a result, a musical signal of a volume and tone color corresponding to the speed of the operation of depressing the key (in the instant case the key for the highest octave note B4) is produced as the musical signal obtained through the D/A converter 19. Although not shown in FIG. 5, it is possible to provide an envelope generator for effecting envelope control of the tone signal and permit control of attack, decay, sustain and release sections of envelope (or attack, sustain and release sections of an envelope).

After the step S18, a step S19 is executed. In the step S19, whether the switch consisting of the movable contact 2c and fixed contact 5c is "on" state is detected. If chattering is produced in the "on" state of switch as shown in (c) in FIG. 7, a step S20 is executed, in which the detection of the switch state is interrupted for 4 msec. After 4 msec, a step S12 is executed.

If the switch of the contacts 2c and 5c remains "on", the operation returns to the step S19. If the switch of the contacts 2c and 5c is in the "on" state, the state of the step S19 is held.

When the operated key 7 (in the instant case the key for the highest octave note B4) is released, a step S20 is executed after the step S19.

In the step S20, the detection of the switch state is interrupted during the period of chattering produced between the movable contact 2c and fixed contact 5c. After 4 msec, a step S21 is executed. If it is detected in the step S21 that the switch of the contacts 2c and 5c is turned "off", a step S22 is executed, in which the data supplied to the latch 15 is cleared to render the tone signal generator 16 inoperative for stopping tbe production of musical sound.

In the instant case, the production of the musical sound of the highest octave note B4 is stopped in consequence. Again in this case, more satisfactory musical sound can be obtained by permitting envelope control by an envelope generator.

The operation then proceeds to the step S7, in which the CPU 11 clears the internal timer before returning to the step S1.

It is to be understood that with the touch response providing apparatus, the tone color is controlled by the initial depressing force exerted to the key 7, i.e., the speed of the key 7 at the time of the measurement of the period tr1 in FIG. 7, and the volume is controlled by the final depressing force exerted to the key 7, i.e., the speed of the key 7 at the time of the measurement of the period tr2. In other words, the tone color is controlled according to the ratio tr2/tr1 between the periods tr1 and tr2 shown in FIG. 7, and the volume is controlled according to the period tr2.

Thus, a keen sound containing many harmonic components may be obtained as the output musical sound when the key is quickly depressed at the outset, while a soft sound which does not substantially contain harmonic components is obtained when the key is slowly depressed. Further, if the final depressing force at the time of the measurement of the period tr2 is strong, high volume is obtained due to high urging speed of the key 7 and, conversely, with a weak final key depressing force the volume of the musical sound produced is low due to a low speed of the key 7.

Table below show a typical example of the combination of sounds.

TABLE

| tr2/tr1 | tr2 | Output musical sound |
|---|---|---|
| High | Long | Keen sound of high volume |
| High | Short | Keen sound of low volume |
| Low | Long | Soft sound of high volume |
| Low | Short | Soft sound of low volume |

While in the above embodiment the volume and tone color of the musical sound have been controlled in accordance with the operation of a key on the keyboard, it is also possible to permit chord performance with the volume and tone color controlled independently for the individual keys operated to produce a chord sound by providing a plurality of tone signal generating circuits or operating a single tone signal generating circuit on a time division basis. In this case, the operation flow (in FIG. 8) of the CPU 11 may be suitably modified.

Figure 9:
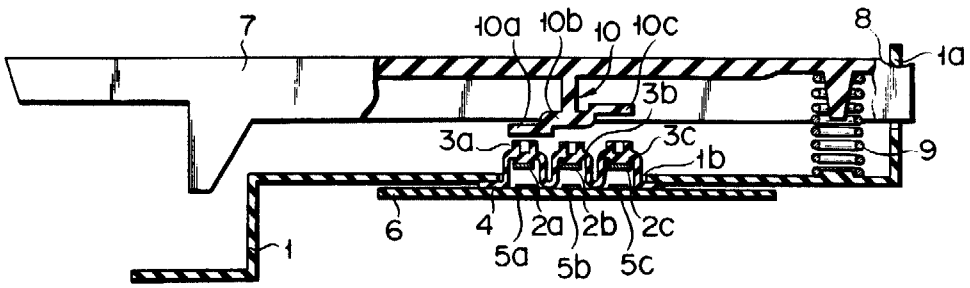
FIG. 9 is a sectional view showing a keyboard section used in a different embodiment of the invention.

FIG. 9 shows a modification of the key construction shown in FIG. 1 in the above embodiment for providing the touch response function. In FIG. 9, like parts as those in FIG. 1 are designated by like reference numerals and symbols, and their description is omitted. In the construction of FIG. 9, contact pairs 2*a* and 5*a*, 2*b* and 5*b* and 2*c* and 5*c* have the same construction as that shown in FIG. 1A. An elastic member 4, which is provided for each key 7, includes three protruding portions 3*a*, 3*b* and 3*c*. These protruding portions 3*a*, 3*b* and 3*c* are provided on the underside with respective movable contacts 2*a*, 2*b* and 2*c* of the same level. Fixed contacts 5*a*, 5*b* and 5*c* are provided on printed circuit board 6 to correspond to the respective movable contacts 2*a*, 2*b* and 2*c*.

An urging portion 10, which serves to urge the flat top ends of the protruding portions 3*a* to 3*c*, has stepped portions 10*a*, 10*b* and 10*c*, with each portion higher in level than the adjacent portion on the front side of the keyboard chassis 1 (i.e., on the left hand side in FIG. 9). Thus, when the key 7 is depressed, the movable contact 2*a* and fixed contact 5*a* are first made, then the movable contact 2*b* and fixed contact 5*b* are made, and finally the movable contact 2*c* and fixed contact 5*c* are made. Thus, like the preceding embodiment, the time periods tr1 and tr2 can be detected in the CPU 11, and the touch response function can be provided.

The key structures of the keyboard shown in FIGS. 1 and 9 according to the invention are by no means limitative, and various changes and modifications are possible.

Figure 10:
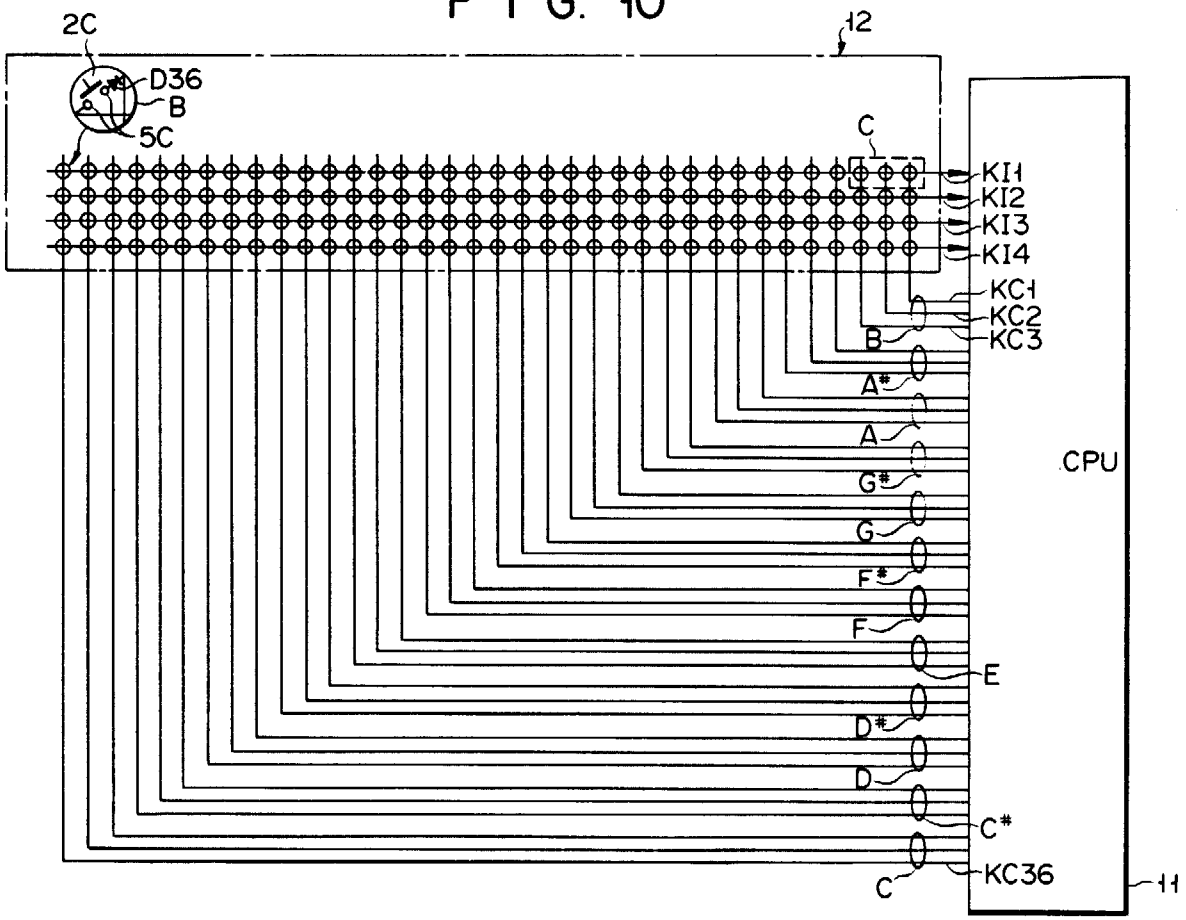
FIG. 10 is a circuit diagram showing a key input section in a further embodiment of the invention.

Further, while in the above embodiment the fixed contacts 5*a* to 5*c* of the three switches for each key have been connected at one end to one of the common electrodes KC1 to KC4 and connected at the other end independently to corresponding ones of the electrodes KIj (j being 1 to 36) as shown in FIG. 3, it is also possible to use a wiring as shown in FIG. 10. In this arrangement, the fixed contacts 5*a* to 5*c* of the three switches for each key are connected at one end to respective separate three common electrodes KCl (l being 1 to 36) and connected at the other end to one of common electrodes KIm (m being 1 to 4). In this case, the same touch response function as in the case of the wiring shown in FIG. 3 may be obtained by merely slightly changing the operation of detecting the operated key in the CPU 11.

Further, various other methods of scanning of the key matrix circuit 12 are conceivable, and method employed in the above embodiments according to the invention are by no means limitative.

Further, while in the above embodiments three switches have been provided for each key for controlling the volume and tone color of the output musical sound according to the periods taken until the three switches are turned on, i.e., the data of tr1 and tr2, it is also possible to provide more than three switches for each key so as to control a plurality of characteristics of the output musical sound according to the periods taken until these switches are turned on.

Figure 11:
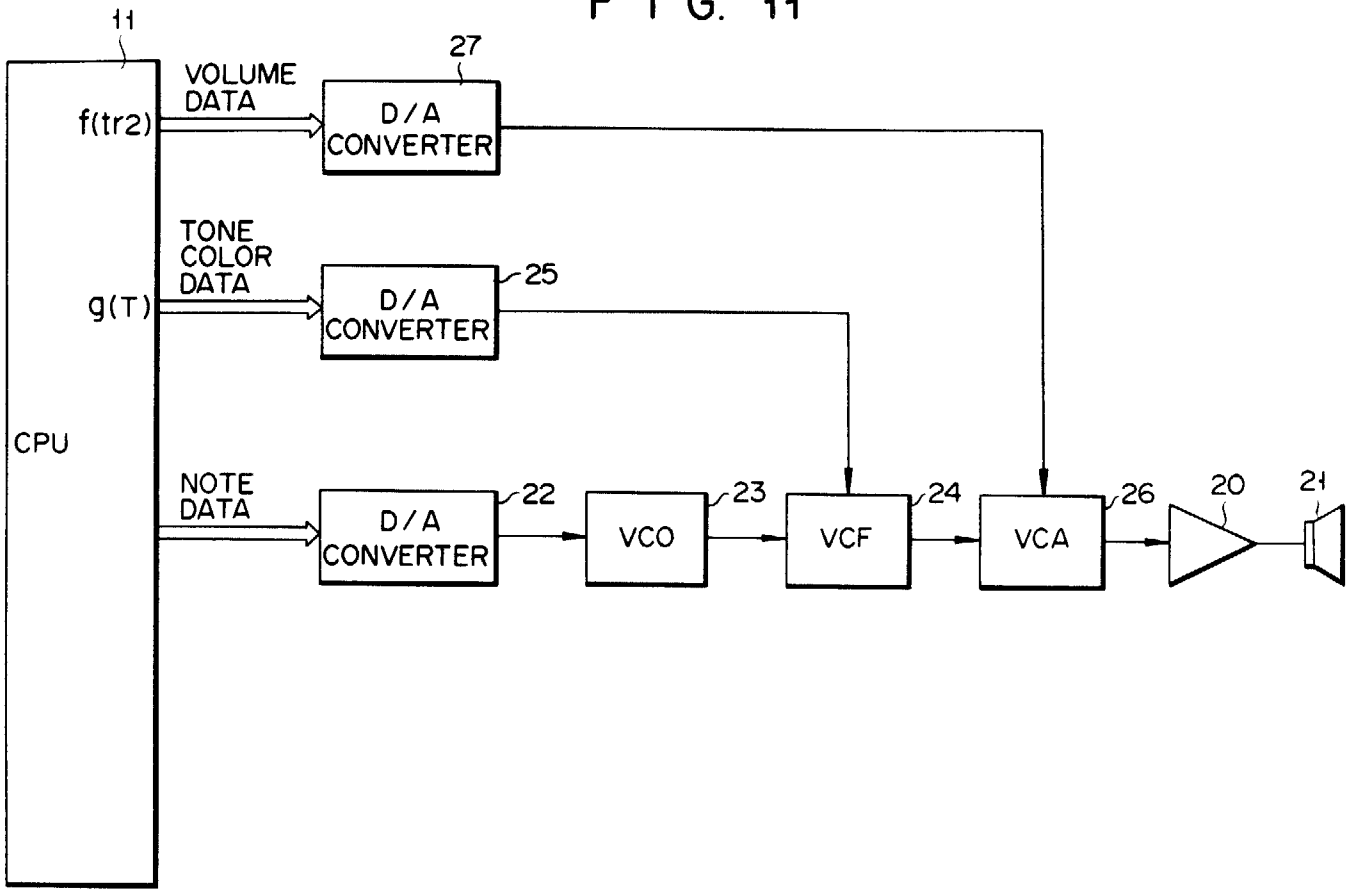
FIG. 11 is a block diagram showing a tone generating section in a further embodiment of the invention.

FIG. 11 shows a modification of the tone signal generating circuit shown in FIG. 5.

In this case, the note data from the CPU 11 is converted through a D/A converter 22 to obtain a voltage signal, which is fed to a VCO (voltage controlled oscillator) 23, and a predetermined frequency signal is provided from the VCO 23. The output of the VCO 23 is fed to a VCF (voltage controlled filter) 24. To the VCF 24, an analog signal provided from a D/A converter 25, to which the filter data g (T) (cut-off frequency data) is supplied from the CPU 11, is fed.

The VCF 24 filters the signal from the VCO 23, and the resultant signal is coupled to a VCA (voltage controlled amplifier) 26.

The VCA 26, to which the volume data f (tr2) is coupled as analog signal through the D/A converter 27, amplifies the signal supplied through the VCF 24 according to the volume data f (tr2), and the amplified output is coupled through a power amplifier 20 to a loudspeaker 21.

Thus, the touch response function is provided with respect to the tone signal according to the control by the CPU 11. Even in this case, by constructing the D/A converters 22, 25 and 27, VCO 23, VCF 24 and VCA 26 such as to have a plurality of channels and permitting the CPU 11 to execute a time sharing operation, it is possible to obtain chord performance with different touch responses provided for the individual component musical sounds of chords.

It is to be understood that with the touch response providing apparatus according to the invention, in which at least three switches are provided for each key for controlling at least two characteristics of the musical sound according to output obtained through the detection of the switch state, two or more different characteristics of the musical sound such as the volume and tone color can be controlled substantially independently according to the periods taken until the aforementioned at least three switches are individually turned on, and thus it is possible to obtain musically rich performance which could not have been obtained with the prior art electronic musical instrument.

Further, since at least one of the aforementioned at least three switches is used for controlling the generation of the relevant musical sound, the provision of the touch response and the control of the musical sound generation can be effected according to the output data from the same switch.

The advantages mentioned above permit the player to acquire the way of providing increasingly rich musical expression with increasing training with the electronic musical instrument according to the invention. Thus, in contrast to the prior art electronic musical instrument, which can produce only monotonous and artificial musical sound, according to the invention a revolutionary electronic musical instrument, which can produce musical sound of increasingly rich musical expression according to the extent of training of the player just like the sound produced by the natural musical instrument, can be obtained.

Further, with the touch response providing apparatus according to the invention, with at least three switches provided for each key for controlling at least two characteristics of the musical sound according to the output obtained through the detection of the switch state, the electric wiring for the individual keys can be extremely reduced compared to the case where all the switches are independently connected to the CPU. Further, the information about the "on" and "off" states of a number of keys can be detected through dynamic scanning, the number of terminals to provide or receive the "on" or "off" state data can be reduced, which is desired from the standpoint of implementation with LSI. Further, with the capability of independently controlling at least two different characteristics of the output musical sound such as volume and tone color according to the periods taken for the turn-on of the aforementioned at least three switches, it is possible to obtain a musically rich performance.

What is claimed is:

1. A touch response providing apparatus for changing the characteristics of output musical sound from an electronic keyboard musical instrument, having a plurality of performance keys, according to the state of operation of a performance key being operated, comprising:

a set of at least three switches coupled to each of said performance keys of the electronic keyboard musical instrument and which are switched in a predetermined order at the time of the operation of said each key;

counting means coupled to said set of at least three switches for each of said keys for counting the periods required for the switching of the individual switches corresponding to an operated key at the time of the key operation, and for providing a count output corresponding to the length of the counted periods; and control means coupled to said counting means for controlling at least two characteristics of the output musical sound produced by the instrument in correspondence with the key operation as a function of the count output of said counting means.

2. The touch response providing apparatus according to claim 1, wherein each set of said at least three switches include:

three movable contacts;

an elastic protruding member, said movable contacts being arranged in a row and insulated from one another such that they depend to different extents from the underside of said elastic protruding member;

projections formed on top of said elastic protruding member in correspondence to the respective movable contacts, said projections having different lengths and being flush with one another at their tops;

an urging section extending above and along the upper ends of said projections; and three fixed contacts provided underneath and facing said respective three movable contacts for respective selective contact therewith.

3. The touch response providing apparatus according to claim 2, wherein said fixed contacts each include at least a set of printed wiring leads formed on a printed wiring board.

4. The touch response providing apparatus according to claim 1, comprising a key matrix circuit; and wherein said three switches occupy respective intersections of said key matrix circuit; said control means supplying a plurality of sequential pulses; said key matrix circuit comprising:

a plurality of common electrode lines supplied with a plurality of sequential pulses provided from said control means according to the number of octaves; and a plurality of electrode lines crossing said common electrode lines and grouped in groups each of three and corresponding to each of different notes, the "on" and "off" states of the switches being scanned by said sequential pulses from said control means and detected in said control means.

5. The touch response providing apparatus according to claim 1, wherein each of said switches comprises a pair of contacts; and wherein said control means has a timer function of counting a first time interval from the turning-on of a first one of said three switches of a given set of switches until the turning-on of the second switch of said given set of switches, and then counting a second time interval from the turning-on of said second switch until the turning-on of the third switch of said given set of switches.

6. The touch response providing apparatus according to claim 5, wherein said control means includes:

means for calculating a volume data and a tone color data on the basis of the counted first and second time intervals; and means for controlling the volume of a note signal generated in response to an operation of the performance key, according to the calculated volume data, and means for controlling the tone color of the note signal in response to the calculated tone color data.

7. The touch response providing apparatus according to claim 6, wherein said control means further includes:

means for obtaining the value of the ratio of said counted first and second time intervals;

a first latch for storing the count value of said second time interval as volume data;

a second latch for storing the value of said ratio as tone color data;

a digital filter receiving a tone signal generated in response to the operation of a performance key and controlled by the output of said second latch; and a multiplier for generating the product of the output of said digital filter and the output of said first latch.

8. The touch response providing apparatus according to claim 1, wherein each set of said at least three switches includes three movable contacts, elastic protruding members, said movable contacts being secured to the underside of said respective protruding members, said protruding members having respective upper projections corresponding to the respective movable contacts and having the respective upper ends flush with one another, an urging member extending above and along the upper ends of said protruding members and coupled to said associated performance key, said urging member having stepped portions extending at different distances from the upper ends of the respectively corresponding protruding members, and three fixed contacts provided underneath and facing said respective three movable contacts.

9. The touch response providing apparatus according to claim 6, wherein said control means further includes:

means for obtaining the value of the ratio of said first and second time intervals; and a first digital/analog converter for providing the count value of said second time interval as analog volume data;

a second digital/analog converter for providing the value of said ratio as tone color;

a VCF receiving the analog note signal formed in response to the operation of a performance key and providing an output having a frequency controlled by the output of said second digital/analog converter; and a VCA receiving the output of said VCF and controlled by the output of said first digital/analog converter.

10. The touch response providing apparatus according to claim 1, which further comprises sound generation control means for controlling the generation of a musical sound corresponding to the operation of the performance key associated with said set of said at least three switches to be started when a predetermined one of said three switches of said set is turned on by operation of said performance kay and to be ended when a predetermined one of said three switches of said set is turned off by said performance key.

11. The touch response providing apparatus according to claim 10, wherein said control means includes means for controlling the volume and tone color of the output musical sound according to the count output of said counting means.

12. The touch response providing apparatus according to claim 11, wherein said control means includes means for controlling to volume of said output musical sound according to the count output for one switch counted by said counting means; and for controlling the tone color of said output musical sound according to the ratio of the count outputs for two switches counted by said counting means.

13. In an electronic keyboard musical instrument having a plurality of performance keys, a touch response providing apparatus comprising:

a key matrix circuit having a set of at least three switches associated with each of the performance keys;

detecting means for scanning said key matrix circuit and for detecting the "on" and "off" states of said pluarlity of performance keys through said scanning of said key matrix circuit; and control means coupled to said detecting means for controlling at least two characteristics of output musical sound produced in response to the operation of a performance key according to the result of detection by said detecting means.

14. The touch response providing apparatus according to claim 13, wherein said detecting means includes means for generating sequential pulses and for impressing said sequential pulses upon said key matrix circuit for the scanning thereof; an "on" signal being provided from a set of at least three switches for an operated performance key in synchronism with said sequential pulses.

15. The touch response providing apparatus according to claim 14, wherein each of said at least three switches of a set provided for each of said performance keys have one end which is commonly connected with the one ends of the other two of said at least three switches of said set, and each switch having another end, said switches being scanned by said sequential pulses from said detecting means; an "on" signal being provided from said another end of said at least three switches of said set in synchronism with said sequential pulses when the relevant switch is operated.

16. The touch response providing apparatus according to claim 15, wherein said at least three switches of a set provided for each of said performance keys are scanned by different sequential pulses provided from said detecting means and impressed upon their one end; an "on" signal being provided from the other end of said at least three switches in synchronism with said sequential pulses when the relevant switch is operated.

* * * * *